US007264435B2

(12) United States Patent
Layko et al.

(10) Patent No.: US 7,264,435 B2
(45) Date of Patent: Sep. 4, 2007

(54) LIFT BOOM ASSEMBLY

(75) Inventors: Michael C. Layko, Apex, NC (US); Jeffrey M. Parker, Apex, NC (US)

(73) Assignee: Caterpillar S.A.R.L., Geneva ( * ) Notice: Subject to any disclaimer, the term of this patent is extended or adjusted under 35 U.S.C. 154(b) by 29 days.

(21) Appl. No.: 11/137,521

(22) Filed: May 26, 2005

(65) Prior Publication Data

US 2006/0269386 A1 Nov. 30, 2006

(51) Int. Cl.
*B66C 23/00* (2006.01)

(52) U.S. Cl. ..... 414/686; 414/917

(58) Field of Classification Search ..... 414/686, 414/680, 685, 917

See application file for complete search history.

(56) References Cited

U.S. PATENT DOCUMENTS

| | | | |
|---|---|---|---|
| 4,355,946 | A | 10/1982 | Wykhuis et al. |
| 5,042,602 | A | 8/1991 | Nakatani et al. |
| 5,078,568 | A | 1/1992 | Lynnes |
| 5,169,278 | A | 12/1992 | Hoechst et al. |
| 5,184,932 | A | 2/1993 | Misuda et al. |
| 5,470,190 | A | 11/1995 | Bamford et al. |
| 5,470,192 | A | 11/1995 | Parri et al. |
| 5,511,932 | A | 4/1996 | Todd et al. |
| 5,542,814 | A | 8/1996 | Ashcroft et al. |
| 5,609,464 | A | 3/1997 | Moffitt et al. |
| 5,807,061 | A | 9/1998 | Donoghue et al. |
| 5,820,332 | A | 10/1998 | Philips et al. |
| 5,964,567 | A | 10/1999 | Bamford |
| 6,132,163 | A | 10/2000 | Andrews et al. |
| 6,171,050 | B1 | 1/2001 | Johnson |
| 6,238,130 | B1 | 5/2001 | Youngers |
| 6,325,589 | B1 | 12/2001 | Jang et al. |
| 6,474,933 | B1 | 11/2002 | Hoechst et al. |
| 6,575,262 | B2 | 6/2003 | Nagatsuka |
| 6,616,398 | B2 | 9/2003 | Dershem et al. |
| 6,679,674 | B1 | 1/2004 | Branham |
| 6,695,568 | B2 | 2/2004 | Bares et al. |
| 2004/0028514 | A1 | 2/2004 | Mimuro |

*Primary Examiner*—Donald Underwood
(74) *Attorney, Agent, or Firm*—Finnegan, Henderson, Farabow, Garrett & Dunner

(57) ABSTRACT

A boom assembly for a work machine including a boom extending from a forward portion of the work machine toward a rear portion of the work machine, a rear link member connected between a frame of the work machine and the boom by a first frame pivot connection and a first boom pivot connection, and a forward link member connected between the frame of the work machine and the boom by a second frame pivot connection and a second boom pivot connection. The boom assembly also includes an actuator connected between the frame of the work machine and the boom by a third frame pivot connection and a third boom pivot connection. The second frame pivot connection is located vertically below the first frame pivot connection and above the second boom pivot connection when the boom assembly is in a lowered position.

22 Claims, 4 Drawing Sheets

LIFT BOOM ASSEMBLY

TECHNICAL FIELD

This disclosure relates generally to a lift boom assembly for a work machine, and more particularly to a lift boom assembly configured to provide a desired work implement vertical lift and lowering path.

BACKGROUND

Various work machines include work implements that are raised and lowered to perform desired tasks. For example, skid steer loader work machines may include a bucket that is raised and lowered to assist in transferring material between desired locations. In many cases, such work implements are coupled to a frame of a work machine by a lift boom assembly that serves to control the movement of the work implement between the lowered and raised positions. Conventional lift boom assemblies include a boom directly coupled to a frame of the work machine by a single pivot connection. This single pivot connection causes the work implement to travel along an arcuate path between the raised and lowered positions. In particular, when the boom starts to raise, there is forward movement of the work implement and, after the boom goes over center, there is a substantial amount of upward and rearward movement of the work implement. This lift path has the drawback of shortening the forward reach of the work implement when the boom is in the raised position.

Attempts have been made to overcome this drawback associated with the arcuate lift path of boom assemblies having a single pivot connection to the work machine frame. For example, U.S. Pat. No. 6,616,398 issued to Brian Dershem, et al. discloses a boom assembly including a boom coupled to each side of a frame of a work machine by a pair of linkages and an actuator. While the boom assembly lift path provided by the disclosed linkage arrangement of the '398 patent may be improved over the lift path of the single pivot boom assembly, as illustrated in FIG. 1 of the '398 patent, the lift path still maintains an arcuate movement between the raised and lowered positions. In addition, the linkage arrangement of the '398 patent may require a greater force than desired to initiate movement of the boom assembly.

The present invention is directed to overcoming one or more of the problems set forth above.

SUMMARY OF THE INVENTION

In accordance with one aspect of the disclosure, a boom assembly for a work machine includes a boom extending from a forward portion of the work machine toward a rear portion of the work machine, a rear link member connected between a frame of the work machine and the boom by a first frame pivot connection and a first boom pivot connection, and a forward link member connected between the frame of the work machine and the boom by a second frame pivot connection and a second boom pivot connection. The boom assembly also includes an actuator connected between the frame of the work machine and the boom by a third frame pivot connection and a third boom pivot connection. The second frame pivot connection is located vertically below the first frame pivot connection and above the second boom pivot connection when the boom assembly is in a lowered position.

According to another aspect of the present disclosure, a work machine includes a frame having a front portion and a rear portion, a front traction assembly located at the front portion of the frame, and a rear traction assembly located at a rear portion of the frame, the rear traction assembly having an axle, and a boom assembly coupled to the frame to allow for movement between a raised and lowered position. The boom assembly includes a boom extending from the front portion of the frame toward the rear portion of the frame, a rear link member connected between the rear portion of the frame and the boom by a first frame pivot connection and a first boom pivot connection, a forward link member connected between the rear portion of the frame and the boom by a second frame pivot connection and a second boom pivot connection, and an actuator connected between the frame of the work machine and the boom by a third frame pivot connection and a third boom pivot connection. The second frame pivot connection being located below the first frame pivot connection and being located forward of the axle of the rear traction assembly. The work machine further includes a work implement coupled to a front portion of the boom.

According to another aspect of the present disclosure, a boom assembly for a work machine includes a boom extending from a forward portion of the work machine toward a rear portion of the work machine, a rear link member connected between a frame of the work machine and the boom by a first frame pivot connection and a first boom pivot connection, and a forward link member connected between the frame of the work machine and the boom by a second frame pivot connection and a second boom pivot connection, the forward link member being located completely above the rear link member when the boom assembly is in a lowered position. The boom assembly also includes an actuator connected between the frame of the work machine and the boom by a third frame pivot connection and a third boom pivot connection.

DETAILED DESCRIPTION

Figure 1:
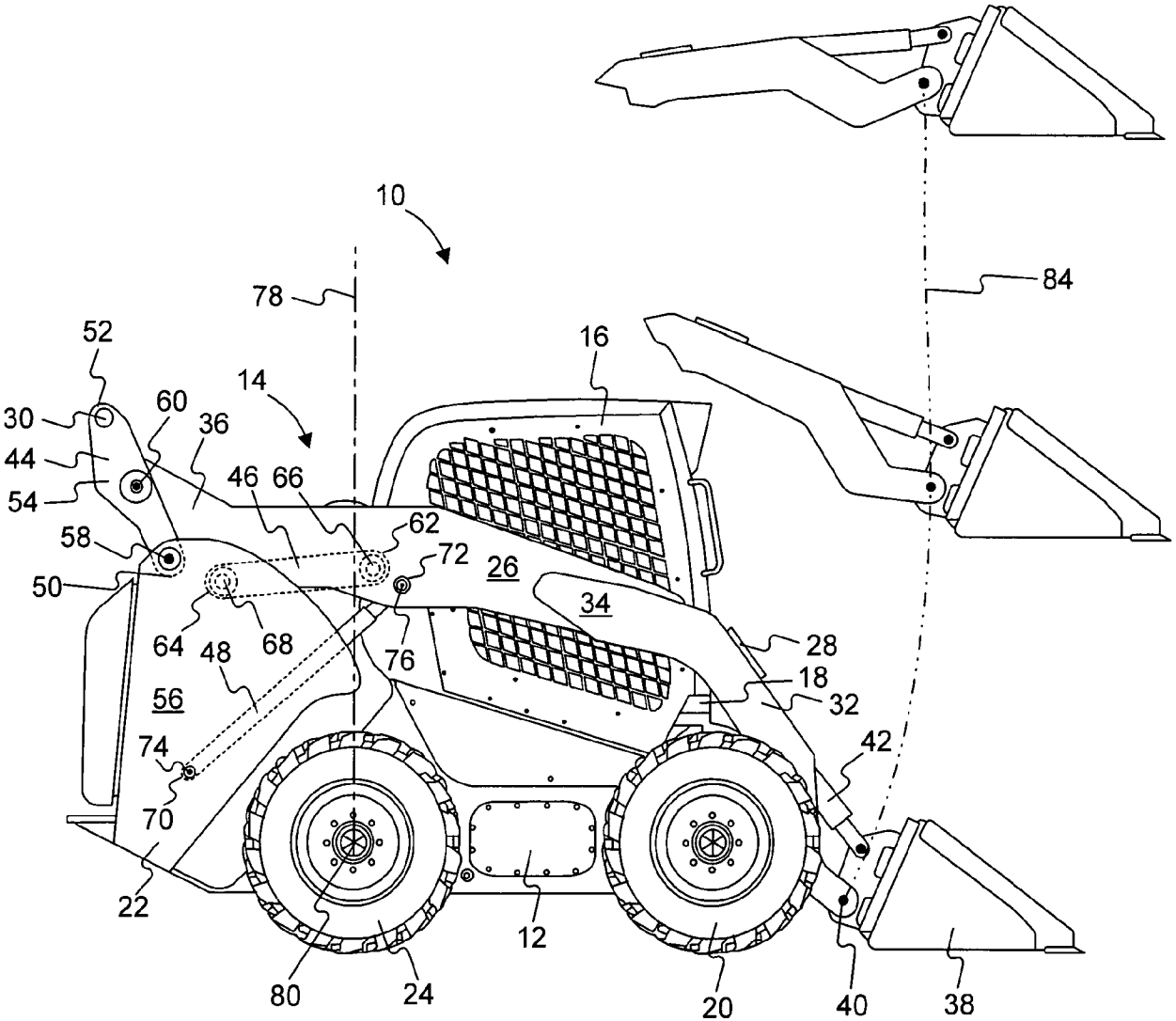
FIG. 1 is a partially-schematic side view of a work machine including a first exemplary boom assembly in a lowered position in accordance with the present disclosure.

With reference to FIG. 1, a work machine 10 includes a frame assembly 12 having a boom assembly 14 and an operator compartment 16 coupled thereto. The work machine 10 is depicted as a skid steer loader, but may be any other type of work machine incorporating a boom assembly 14 for performing work. For example, work machine 10 may alternatively be a front end loader or backhoe loader type work machine. The frame assembly 12 includes a front frame portion 18 having a front traction assembly 20, and a rear frame portion 22 having a rear traction assembly 24. Front and rear traction assemblies 20, 24 may include wheels as shown in FIG. 1, or may include portions of a track type traction assembly.

Boom assembly 14 may include a pair of booms 26 located on opposite sides of the frame assembly 12 (only one boom is shown in the figures). Each boom 26 is formed in a substantially similar manner and may be connected together by one or more cross members 28, 30 extending across the work machine 10. Each boom 26 includes a front boom portion 32, a middle boom portion 34, and a rear boom portion 36. When in a lowered position as shown in FIG. 1, rear boom portion 36 may extend generally horizontally and middle and front boom portions 34, 32 may together extend generally downwardly toward the ground. Alternatively, boom 26 could be of any other appropriate shape extending from front frame portion 18 toward rear frame portion 22. Each boom 26 may include a single, integral beam, or may include numerous boom segments fixedly coupled together in any appropriate manner.

Front boom portion 32 of boom 26 may include a work implement 38 coupled thereto. Work implement 38 may include a bucket as shown in FIG. 1, or any other type of work implement known in the art. For example, work implement 38 may alternatively include a fork lift assembly. Work implement 38 may be coupled to front boom portion 32 in any conventional manner. For example, work implement 38 may be directly connected to front boom portion 32 by pivot connection 40, and indirectly connected to front boom portion 32 by an operator controlled hydraulic or pneumatic actuator 42.

Rear boom portion 36 may be connected to a rear link member 44, a forward link member 46, and a hydraulic or pneumatic actuator 48 to provide a coupling between the boom 26 and the rear frame portion 22. Rear link member 44 may include a first end portion 50, a second end portion 52, and an intermediate or middle portion 54. First end portion 50 of rear link member 44 may be pivotally coupled to a tower assembly 56 of rear frame portion 22 to form a frame pivot connection 58 of rear link member 44. Second end portion 52 of rear link member 44 may include cross member 30 extending across the work machine 10 and connecting to a second end portion of a second rear link member (not shown). Intermediate portion 54 of rear link member 44 may include a boom pivot connection 60 coupling the rear link member 44 and rear boom portion 36 of boom 26. As illustrated in FIG. 1, rear link member 44 may extend rearwardly and upwardly between the first end portion 50 and the second end portion 52 when the boom assembly 14 is in the lowered position. As used herein, the "lowered position" of the boom assembly 14 identifies the position of the boom assembly when the work implement is located on or adjacent the ground.

Forward link member 46 may include a first end portion 62 and a second end portion 64. First end portion 62 of forward link member 46 may be pivotally connected to rear frame portion 22 to form a frame pivot connection 66 of forward link member 46. Second end portion 64 of forward link member 46 may include a boom pivot connection 68 coupling the second end portion 64 of forward link member 46 and the rear boom portion 36. As shown in FIG. 1, forward link member 46 may extend rearwardly and downwardly between the first end portion 62 and the second end portion 64 when the boom assembly 14 is in the lowered position.

Figure 2:
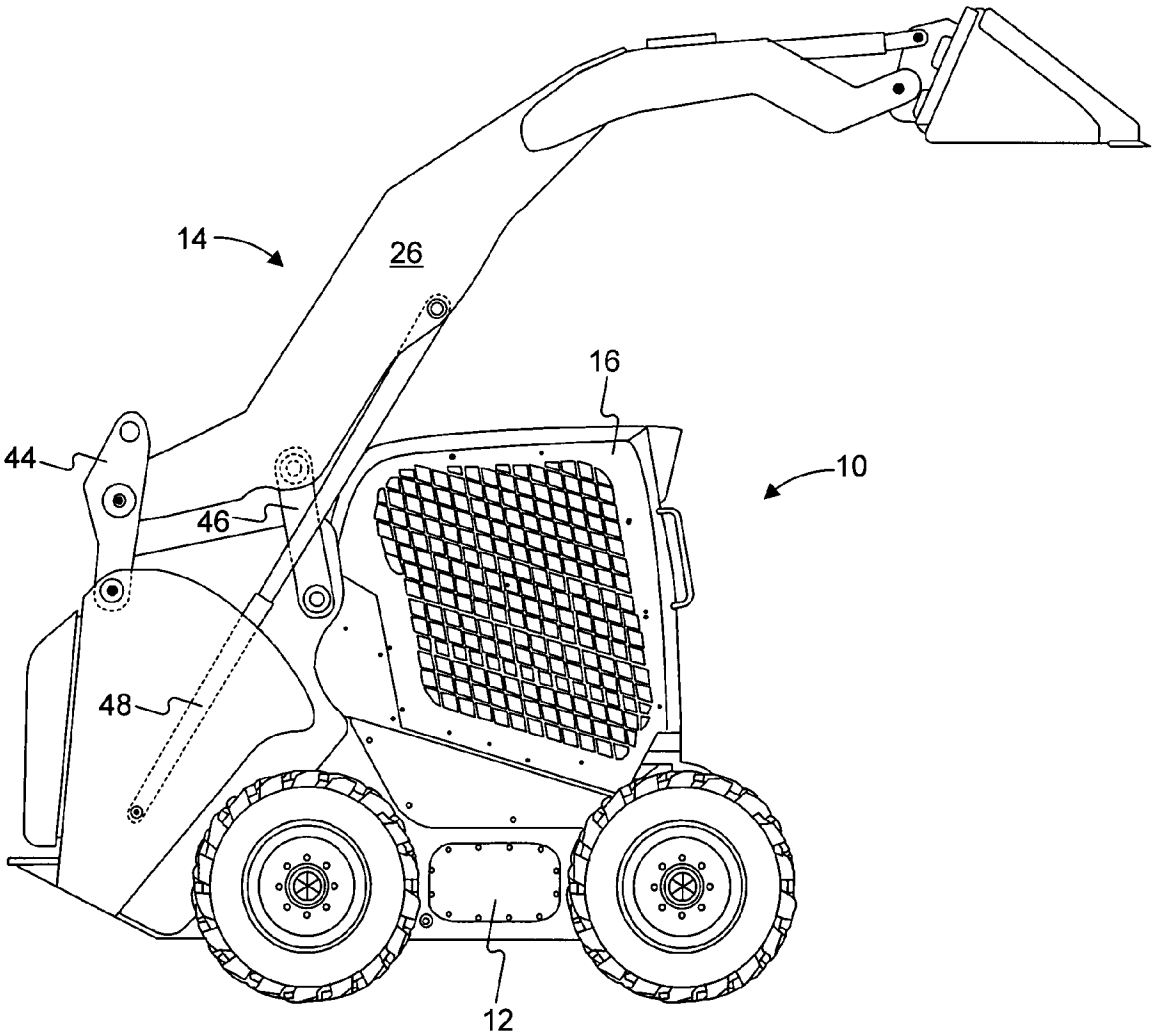
FIG. 2 is partially-schematic side view of the work machine of FIG. 1 with the boom assembly in a raised position.

Actuator 48 may include a first end portion 70 and a second end portion 72. First end portion 70 of actuator 48 may be pivotally connected to rear frame portion 22 to form a frame pivot connection 74 of actuator 48. Second end portion 72 of actuator 48 may be connected to the intermediate boom portion 34 by boom pivot connection 76. As illustrated in FIG. 1, actuator 48 may extend forwardly and upwardly along the work machine 10 between the first end portion 70 and second end portion 72 when the boom assembly 14 is in the lowered position. As noted above, actuator 48 may be actuated hydraulically or pneumatically and may be configured to include the actuator cylinder at either the first or second end portions 70, 72 of the actuator 48. Finally, actuator 48 may be controlled in any appropriate manner, including by electronically, hydraulically, or pneumatically driven actuator valves receiving control signals based on, for example, work machine operator input received from within the operator compartment 16 of the work machine 10. FIG. 2 illustrates the boom assembly 14 in the raised position with the actuator 48 extended.

Referring again to FIG. 1, the location of the rear link member 44, forward link member 46, and actuator 48 will be described with respect to the position 78 of an axle 80 of the rear traction assembly 24, and with respect to the boom assembly 14 being in the lowered position shown in the figure. Frame pivot connection 58 of rear link member 44 and frame pivot connection 74 of actuator 48 are both located rearward of the axle 80 of the rear traction assembly 24, with the frame pivot connection 58 of the rear link member 44 being positioned a greater distance rearwardly of the axle 80 than the frame pivot connection 74 of the actuator 48. Frame pivot connection 66 of forward link member 46 may be located forward of axle 80 of the rear traction assembly 24. In addition, the frame pivot connection 66 of forward link member 46 may be located vertically between the frame pivot connections 58 and 74 of the rear link member 44 and the actuator 48.

Again with respect to the boom assembly 14 in the lowered position as shown in FIG. 1, the boom pivot connections 60 and 68 of the rear link member 44 and the forward link member 46 may be positioned rearward of the axle 80 of the rear traction assembly 24, with the boom pivot connection 60 of the rear link member 44 positioned a greater distance rearwardly of axle 80 than the boom pivot connection 68 of the forward link member 46. The boom pivot connection 76 of the actuator 48 may be located forward of the axle 80. In addition, when the boom assembly 14 is in the lowered position, boom pivot connection 60 of the rear link member 44 may be located above the boom pivot connection 68 of forward link member 46, which may be located above the boom pivot connection 76 of the actuator 48.

Figure 3:
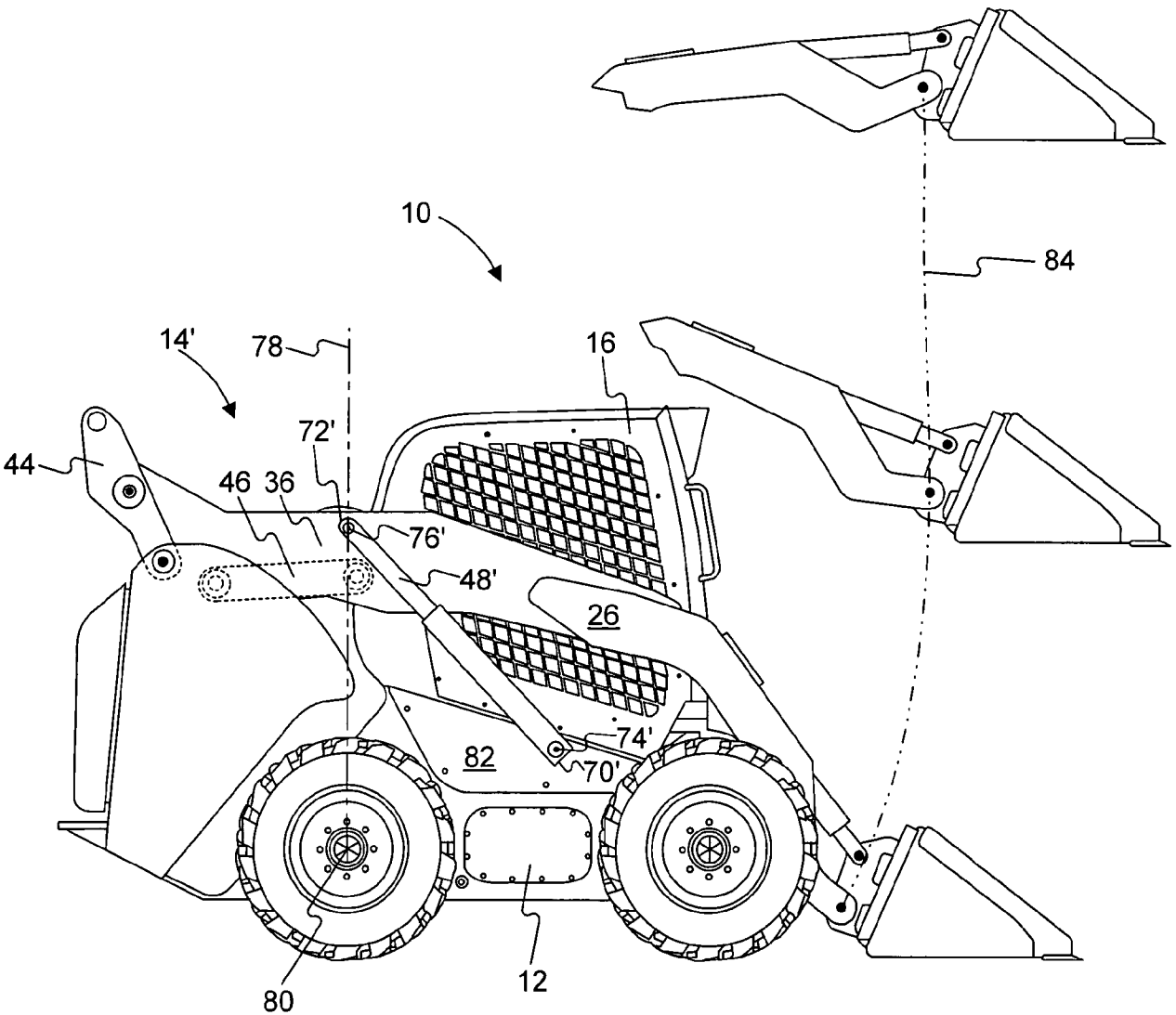
FIG. 3 is a partially-schematic side view of a work machine including a second exemplary boom assembly in accordance with the present disclosure.

In the alternative boom assembly 14' illustrated in FIG. 3, the same reference numbers are used to represent the same or similar parts. Boom assembly 14' may include an actuator 48' having a first end portion 70' and a second end portion 72'. First end portion 70' of actuator 48' may be pivotally connected to middle portion 82 of frame assembly 12 to form a frame pivot connection 74' of actuator 48'. Second end portion 72' of actuator 48' may be connected to the rear boom portion 36 of boom 26 by boom pivot connection 76'. As illustrated in FIG. 3, actuator 48' may extend rearwardly and upwardly along the work machine 10 between the first end portion 70' and second end portion 72' when the boom assembly 14 is in the lowered position. As noted above, actuator 48' may be actuated hydraulically or pneumatically and may be configured to include the actuator cylinder at either the first or second end portions 70', 72' of the actuator 48'. In addition, actuator 48' may be controlled in any appropriate manner, including by electronically, hydraulically, or pneumatically driven actuator valves receiving control signals based on, for example, work machine operator input received from within the operator compartment 16 of the work machine 10.

When the boom assembly 14' is in the lowered position as shown in FIG. 3, frame pivot connection 74' of actuator 48' is located forward of axle 80 of the rear traction assembly 24, and the boom pivot connection 76' of the actuator 48' is in substantial alignment with the rearward position 78 of axle 80. It is understood, however, that boom pivot connection 76' of the actuator 48' could be located at a different location forward or rearward of the axle 80. In addition, boom pivot connection 76' of actuator 48' may be located above the frame and boom pivot connections 66, 68 of forward link member 46, and vertically between the frame and boom pivot connections 58, 60 of the rear link member 44.

Figure 4:
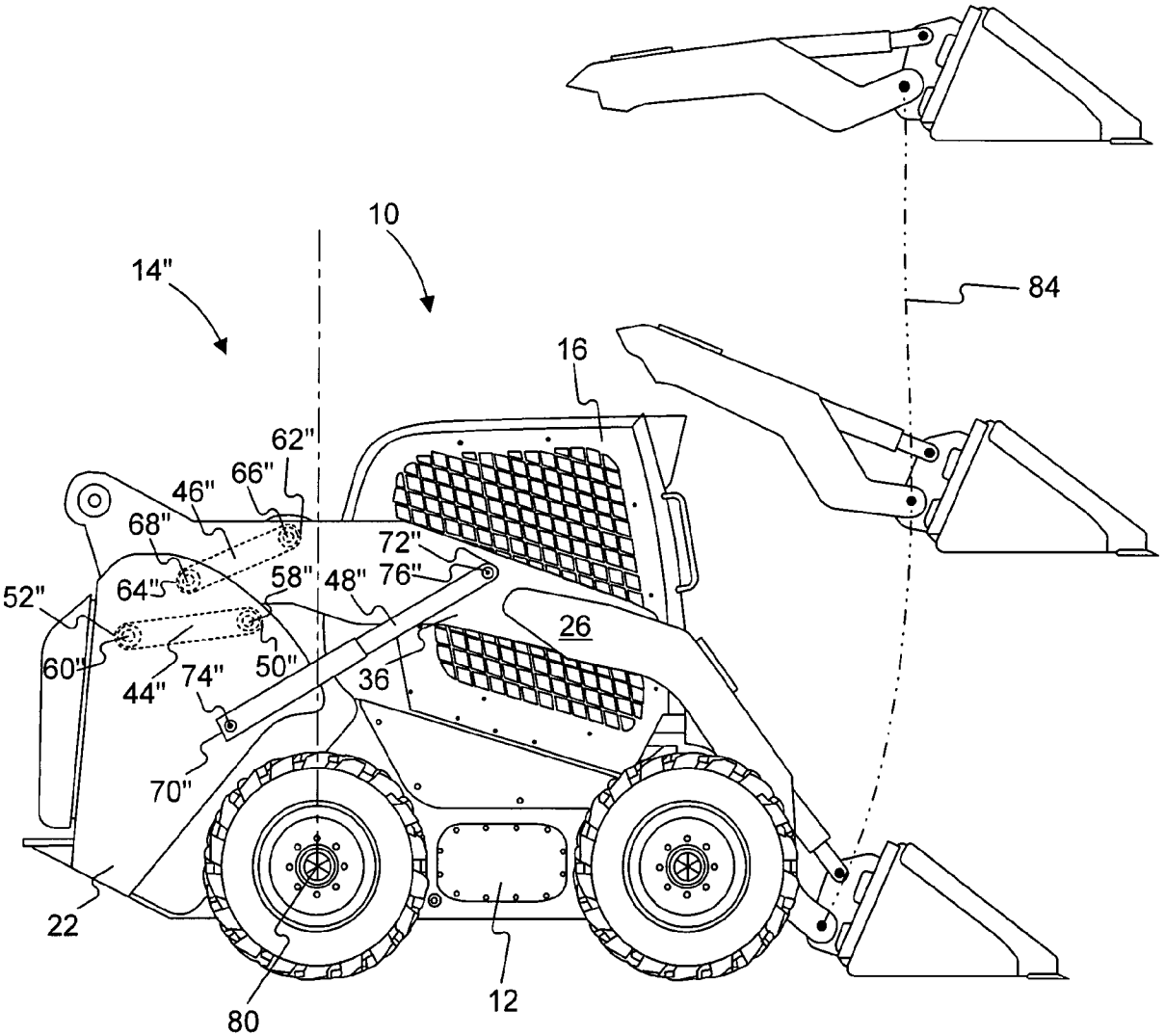
FIG. 4 is a partially-schematic side view of a work machine including a third exemplary boom assembly in accordance with the present disclosure.

With respect to the further alternative boom assembly embodiment illustrated in FIG. 4, again, the same reference numerals discussed above will be used to refer to the same or similar parts. The boom assembly 14" of FIG. 4 may include a rear link member 44", a forward link member 46", and an actuator 48". In this boom assembly 14", the frame pivot connections 58", 66", and 74" of the rear link member, 44", forward link member 46", and actuator 48", respectively, may be located rear of axle 80, with the frame pivot connection 58" of the rear link member 44" being located between the frame pivot connections 62" and 70" of the forward link member 46" and actuator 48". In addition, frame pivot connection 58" of rear link member 44" may be located vertically between the frame pivot connections 66", 74" of the forward link member 46" and actuator 48". The boom pivot connections 60" and 68" of the rear link member 44" and the forward link member 46" may each be located rewardly of the axle 80 when the boom assembly 14" is in the lowered position. The boom pivot connection 76" of the actuator 48" may be located forward of the axle 80. With such an arrangement, boom pivot connection 68" is located both vertically and horizontally between boom pivot connections 60" and 76" of the rear link member 44" and actuator 48", respectively.

INDUSTRIAL APPLICABILITY

The disclosed boom assembly may be used with any work machine having a work implement that is raised and lowered to perform a desired task. In one exemplary embodiment, the boom assembly may be used on a skid steer loader type work machine.

Referring to FIGS. 1 and 2, during operation of the work machine 10, an operator manipulates the boom assembly to a desired vertical position via operator controls (not shown) located in the operator compartment 16. Based on the input received from the operator controls, the actuators 48 of the work machine will either extend or retract to adjust the boom member 26 to a desired location. When the boom assembly 14 is initially moved from the lowered position by the hydraulic actuators 48, the rear link member 44 is pivoted rearward about frame pivot connection 58 a predetermined distance. Simultaneously, the forward link member 46 is pivoted upward about frame pivot connection 66. Upon further movement of the lift boom assembly 14 to the raised position, the rear link member 44 is pivoted forward about frame pivot connection 58. As illustrated in FIG. 2, the rear link member 44 is positioned slightly forward of vertical when the boom assembly 14 is in the raised position.

The boom assemblies 14' and 14" are moved between the raised and lowered positions in the same manner as the boom assembly 14 of FIG. 1. In particular, actuators 48' and 48" extend and retract to move the boom assemblies 14' and 14" to a desired location.

The disclosed boom assembly utilizes components with pivot connections located at precise locations on the frame 12 of the work machine 10 that cooperate together to achieve an efficient boom assembly design that requires less force to initiate movement of the boom assembly from the lowered position. In addition, the orientation and connection of the components and the associated pivot connections ensure that the lift path 84 for the lift boom assembly 14 only arcs slightly forwardly from the lowered position to a maximum reach in the lower half of the lift range and is followed by a linear path to the raised position. This lift path allows the forward reach of the work implement to extend closer to a desired object located forward of the work machine when the boom assembly is in a raised position.

Other embodiments of the invention will be apparent to those skilled in the art from consideration of the specification and practice of the invention disclosed herein. For example, It is intended that the specification and examples be considered as exemplary only, with a true scope of the invention being indicated by the following claims.

What is claimed is:

1. A boom assembly for a machine, comprising:

a boom extending from a forward portion of the machine toward a rear portion of the machine;

a rear link member connected between a frame of the machine and the boom by a first frame pivot connection and a first boom pivot connection;

a forward link member connected between the frame of the machine and the boom by a second frame pivot connection and a second boom pivot connection, the forward link member being disposed generally forward of the rear link member when the boom assembly is in a lowered position; and an actuator connected between the frame of the machine and the boom by a third frame pivot connection and a third boom pivot connection, the second frame pivot connection being located vertically below the first frame pivot connection and above the second boom pivot connection when the boom assembly is in the lowered position.

2. The boom assembly of claim 1, wherein the second frame pivot connection and the third boom pivot connection are located forward of an axle of a rear traction member of the machine.

3. The boom assembly of claim 1, wherein a cross member is coupled to an end portion of the rear link member and extends across the machine.

4. The boom assembly of claim 1, wherein the second boom pivot connection is located horizontally between the first frame pivot connection and the second frame pivot connection when the boom assembly is in the lowered position.

5. The boom assembly of claim 1, wherein the third frame pivot connection is located horizontally between the first frame pivot connection and the second boom pivot connection when the boom assembly is in the lowered position.

6. The boom assembly of claim 1, wherein the third boom pivot connection is located forward of the second frame pivot connection when the boom assembly is in the lowered position.

7. The boom assembly of claim 1, wherein the third frame pivot connection is located forward of an axle of a rear traction member of the machine and the actuator extends rearwardly from the third frame pivot connection to the third boom pivot connection when the boom assembly is in a lowered position.

8. The boom assembly of claim 1, wherein the third boom pivot connection is located above the second frame pivot connection when the boom assembly is in a lowered position.

9. A machine, comprising:

a frame having a front portion and a rear portion;

a front traction assembly located at the front portion of the frame, and a rear traction assembly located at a rear portion of the frame, the rear traction assembly having an axle;

a boom assembly coupled to the frame to allow for movement between a raised and lowered position, the boom assembly including;

a boom extending from the front portion of the frame toward the rear portion of the frame;

a rear link member connected between the rear portion of the frame and the boom by a first frame pivot connection and a first boom pivot connection;

a forward link member connected between the rear portion of the frame and the boom by a second frame pivot connection and a second boom pivot connection; and an actuator connected between the frame of the machine and the boom by a third frame pivot connection and a third boom pivot connection, the second frame pivot connection being located below the first frame pivot connection and being located forward of the axle of the rear traction assembly; and a work implement coupled to a front portion of the boom.

10. The machine of claim 9, wherein the third boom pivot connection is located forward of the axle of the rear traction member.

11. The machine of claim 9, wherein a cross member is coupled to an end portion of the rear link member and extends across the machine.

12. The machine of claim 9, wherein the second boom pivot connection is located horizontally between the first frame pivot connection and the second frame pivot connection when the boom assembly is in the lowered position.

13. The machine of claim 9, wherein the third frame pivot connection is located horizontally between the first frame pivot connection and the second boom pivot connection when the boom assembly is in the lowered position.

14. The machine of claim 9, wherein the third boom pivot connection is located forward of the second frame pivot connection when the boom assembly is in the lowered position.

15. The machine of claim 9, wherein the third frame pivot connection is located forward of an axle of a rear traction member of the machine and the actuator extends rearwardly from the third frame pivot connection to the third boom pivot connection with the boom assembly is in a lowered position.

16. The boom assembly of claim 9, wherein the third boom pivot connection is located above the second frame pivot connection when the boom assembly is in a lowered position.

17. The boom assembly of claim 1, wherein at least one of the frame pivot connection and the boom pivot connection associated with the rear link member is located rearwardly of the corresponding frame pivot connection and the boom pivot connection associated with the forward link member.

18. The boom assembly of claim 1, wherein the forward link member is located entirely forward of the rear link member when the boom assembly is in a lowered position.

19. A boom assembly for a machine, comprising:

a boom extending from a forward portion of the machine toward a rear portion of the machine;

a rear link member connected between a frame of the machine and the boom by a first frame pivot connection and a first boom pivot connection;

a forward link member connected between the frame of the machine and the boom by a second frame pivot connection and a second boom pivot connection; and an actuator connected between the frame of the machine and the boom by a third frame pivot connection and a third boom pivot connection, the second frame pivot connection being located vertically below the first frame pivot connection and above the second boom pivot connection when the boom assembly is in a lowered position, and the second boom pivot connection being located horizontally between the first frame pivot connection and the second frame pivot connection when the boom assembly is in the lowered position.

20. The boom assembly of claim 19, wherein the second frame pivot connection and the third boom pivot connection are located forward of an axle of a rear traction member of the machine.

21. The boom assembly of claim 19, wherein the third frame pivot connection is located horizontally between the first frame pivot connection and the second boom pivot connection when the boom assembly is in the lowered position.

22. The boom assembly of claim 19, wherein the third boom pivot connection is located forward of the second frame pivot connection when the boom assembly is in the lowered position.

* * * * *